United States Patent [19]

McGregor

[11] 4,367,862

[45] Jan. 11, 1983

[54] ROLLER CHAIN-CONNECTING TOOL

[75] Inventor: Robert I. McGregor, Chemainus, Canada

[73] Assignee: Nordic Diving Salvage & Marine Contractors Ltd., British Columbia, Canada

[21] Appl. No.: 240,027

[22] Filed: Mar. 3, 1981

[51] Int. Cl.[3] ..... B66F 3/08

[52] U.S. Cl. ..... 254/231; 24/68 CT; 254/234

[58] Field of Search ..... 254/231, 233, 234, 232, 254/235, 246, 358; 24/68 CT, 68 D, 68 CD, 68 TT; 81/157, 163; 269/242, 244, 245, 260

[56] References Cited

U.S. PATENT DOCUMENTS

| | | | |
|---|---|---|---|
| 752,074 | 2/1904 | Jackson . | |
| 762,060 | 6/1904 | Huhn | 254/234 |
| 1,505,549 | 8/1924 | Faerch | 254/234 |
| 1,994,270 | 3/1935 | Cetrano . | |
| 2,382,447 | 8/1945 | Schaeufele . | |
| 2,950,899 | 8/1960 | Wilson . | |
| 3,648,973 | 3/1972 | Farrell | 254/231 |
| 4,157,171 | 6/1979 | Hasselas | 254/231 |

FOREIGN PATENT DOCUMENTS

| | | | |
|---|---|---|---|
| 2389 | of 1800 | United Kingdom | 254/234 |

*Primary Examiner*—Billy S. Taylor

*Attorney, Agent, or Firm*—Klarquist, Sparkman, Campbell, Leigh, Whinston & Dellett

[57] ABSTRACT

A roller chain-connecting tool comprises a narrow elongated body containing a lengthwise-extending threaded rod journaled in and extending through both ends of the body to hexagonal bolt heads for rotating the rod. A chain hook is mounted on the threaded rod by means of an internally threaded block which moves lengthwise along the tool's body when the rod is turned. In one embodiment, a second chain hook is mounted on one end of the body and the rod is threaded in only one direction. In another embodiment, the second chain hook is mounted on another internally-threaded block and the threaded rod has approximately one half threaded in each direction from its center. The chain hooks or jaws are gently curved toward one another and are tapered so as to fit both small and large gauge roller chains, the large chains being at least twice the size of the small chains. The sides of the body are spaced laterally apart from the threaded rod and from the sides of the internally-threaded block or blocks so that one or both hooks can rotate through a small angular range for easy manipulation of the tool in awkward locations.

8 Claims, 7 Drawing Figures

FIG. 1
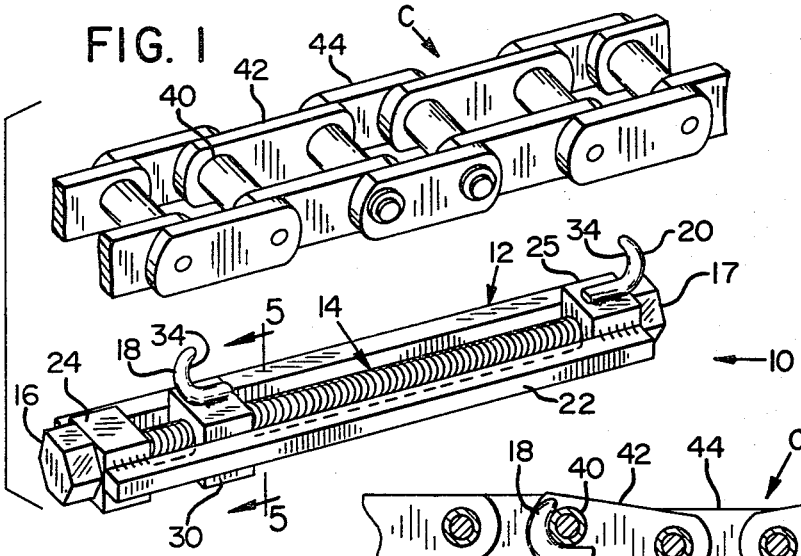
FIG. 2
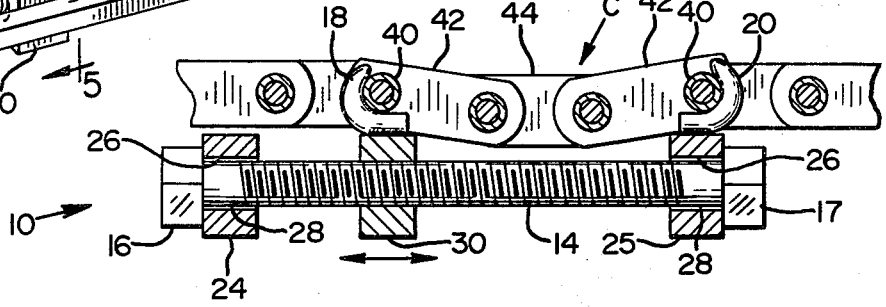
FIG. 3
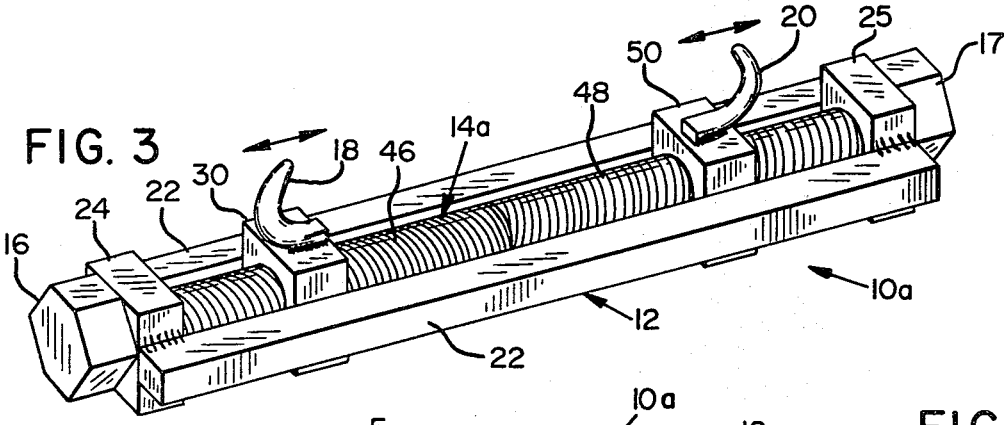
FIG. 4
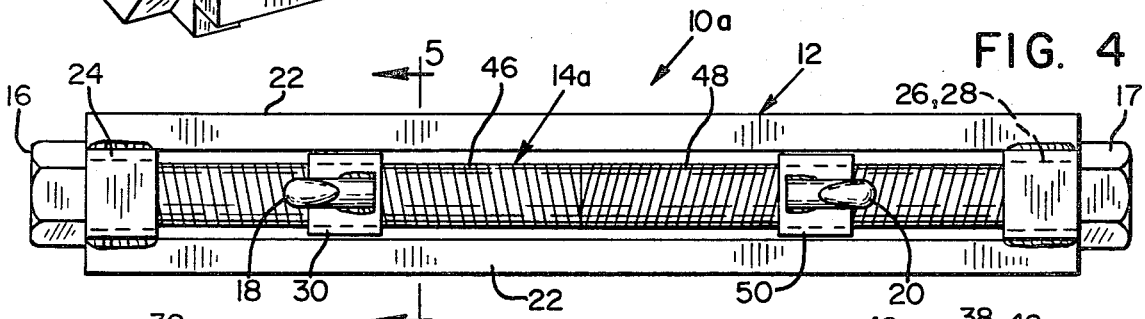
FIG.5
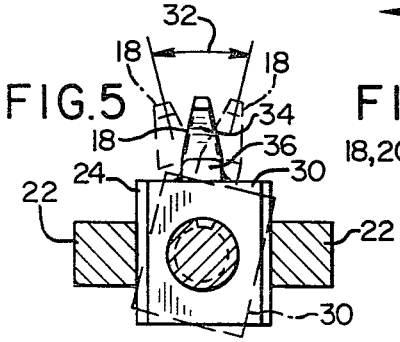
FIG.6
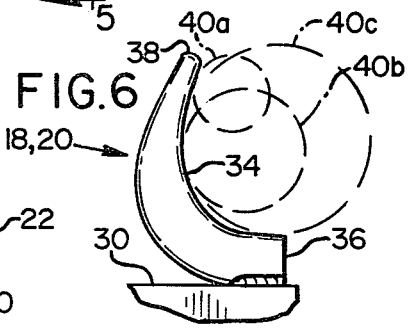
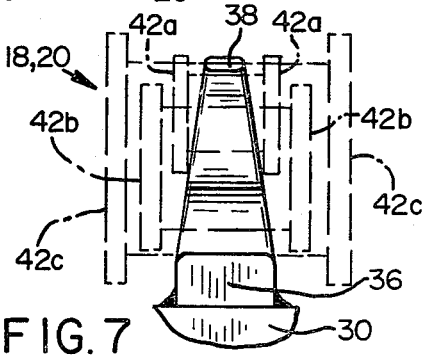
FIG. 7

ROLLER CHAIN-CONNECTING TOOL

BACKGROUND OF THE INVENTION

This invention relates generally to chain-connecting tools and more specifically to screw-type chain tighteners for use in connecting together the ends of roller chains.

Roller chains are widely used in lumber-handling machinery in lumber mills. Due to the heavy loads to which they are subjected, such chains frequently break. As a result of constant usage in an adverse environment, they also tend to wear out very quickly. Consequently, such chains require frequent maintenance, repair and replacement.

Repair of roller chains in lumber-handling machinery can be extremely difficult. Such chains are frequently positioned in very awkward locations. Sometimes multiple roller chains are positioned side by side, very closely together. Their lengths can range from very short to very long, for example, from four or five feet in length to dozens of feet or longer. In the case of very short chains, their sprockets are positioned closely together along the length of the chain. Longer chains may be positioned in narrow guideways or behind protective shields which are not always removable to gain access to the chain. Many different sizes of chains are used in a typical sawmill, and sometimes in a single piece of lumber-handling equipment.

Such an environment imposes rather stringent requirements on any tools that might be used in repairing roller chains. The great length of some chains requires a tool capable of stretching such chains over a long distance. The short length of other chains requires a tool capable of fitting into short distances between the sprockets on which such chains are mounted. Close lateral spacing between the chains or placement in guideways, behind guard shields, or simply in hard-to-reach places, can make it very difficult to position tools on the chains to rejoin their ends. Finally, the common use of different size chains frequently necessitates the use of different-sized tools.

It would be desirable to have a single tool usable to connect both long and short roller chains of differing gauges. It should be positionable on chains in narrow guideways or behind guard shields and yet short enough to fit lengthwise between closely spaced sprockets. Existing chain tighteners and positioning tools meet some of these requirements, but none meets all of them.

U.S. Pat. No. 752,074 to Jackson discloses a chain tightener designed for use in repairing bicycles and early model chain-drive cars. This tool employs a pair of opposed jaw heads interconnected by parallel, oppositely-directed shafts, each fixed in one head and extending through a bore in the other head. A wing nut is threaded on one shaft for advancing one head toward the other. On one side of the jaw heads is mounted a pair of large jaws or hooks for large roller chains. On the other side is a pair of small hooks for engaging small chains. This tool has many disadvantages. The oppositely-directed rods make it overly long for use with very short chains. The wing nut cannot retract the heads to initially position them on the chain. The wing nut must also be turned manually, not only because its shape will not fit a wrench, but because the threaded rod protrudes through it, precluding use of a socket wrench. The unthreaded rod is needed to keep the heads parallel while tightening a chain, but makes it difficult for this tool to fit into very narrow spaces, such as along a guideway or behind a chain guard shield. Provision for separate pairs of chain hooks to fit two different sizes of chain makes the tool even more cumbersome.

U.S. Pat. No. 1,994,270 to Cetrano discloses another form of tool for use in repairing chains. This tool has a pair of block-shaped slides. A square shaft or bar extends through the slides, each of which mount four chain hooks, one on each side of the block. A lever-actuated camming lobe is pivotally-mounted on each end of the shaft in position to move the slides together. Obviously, this tool is not readily usable in close spaces where the levers cannot be worked. In addition, the radii of the camming lobes limit the amount by which a chain can be stretched. Long chains frequently must be stretched more than this tool is capable of stretching them.

U.S. Pat. No. 2,950,899 to Wilson discloses an H-shaped, lever-type chain-positioning tool comprising a pair of levers pivotally connected to a cross bar. A pair of opposed chain hooks are mounted on two adjacent ends of the levers. A screw extends parallel to the cross bar through the opposite ends of the levers. Half-lengths of the screw are threaded in opposite directions for moving the hooks in opposite directions when the screw is rotated. This tool requires more space than is often available in lumber-handling equipment. Like the Cetrano tool, it has a limited range of operation to stretch a chain. To stretch a very long chain, one of the levers must be repositioned on the cross bar. This procedure requires dismantling and reassembling the tool, which is time-consuming and risks loss of tool parts.

Tools for use in repairing tracks on track-type vehicles, such as combat tanks and crawler tractors, are also known. U.S. Pat. No. 2,382,447 to Schaeufele discloses a track maintenance tool comprising a pair of parallel side plates connected at adjacent ends by end blocks. A screw journaled in one end block extends lengthwise between the parallel side plates and is threadedly received in an internally-threaded sliding block. A hook shaped to engage a track pin is mounted on the sliding block. A second such hook is mounted on the end block adjacent the free end of the screw. Rotation of the screw moves the slide block along the slide plates to tighten the track. The lateral sides of the sliding block are channeled to slidingly receive the slide plates. This arrangement is required to keep the hooks parallel and avoid bending the screw while tightening the track, but necessitates precision machining. This arrangement also prevents relative rotation of the hooks which would be disadvantageous in a roller chain-connecting tool because it would limit the ability to maneuver the tool in a very tight location for positioning the hooks in a roller chain. The journaled end of the screw carries a ratchet and a pawl lever is pivotally mounted thereon for turning the screw. Detachable wrenches cannot be used with this tool. Moreover, the screw can only be turned from one end, which is disadvantageous when working in inaccessible places.

Other related devices are disclosed in U.S. Pat. Nos. 949,458; 1,929,026; 2,387,551 and 2,818,229. Two forms of clamp are disclosed in U.S. Pat. Nos. 442,733 and 3,425,098. However, such devices are either altogether unsuited for connecting the ends of roller chains or suffer from the deficiencies of one or more of the tools discussed in greater detail above.

None of the foregoing patents discloses an all-purpose chain-tightening and connecting tool usable on both long and short chains of both light and heavy gauge and yet positionable and operable in very tight places. Accordingly, a need remains for a single, all-purpose chain-connecting tool meeting these requirements.

SUMMARY OF THE INVENTION

One object of the invention is to provide a simple, general purpose chain-connecting tool.

Another object of the invention is to provide a chain tightening and connecting tool which is both easy to manufacture and easy to use.

Another object of the invention is to provide a tool capable of tightly stretching a roller chain of great length in a single-step operation.

A further object of the invention as aforesaid is to provide a tool which can easily be maneuvered into tight spaces, such as along chain guideways, behind chain guards or between closely-spaced sprockets.

Yet another object of the invention is to minimize binding and frictional contact between the moving parts of the tool.

A yet further object is to enable the chain hooks to be rotated relative to one another through a small angular range so as to ease mounting the tool on a roller chain in tight places.

Other objects of the invention include:

1. Providing a single tool which can be used with different size chains;

2. Operating the chain-connecting tool from either end; and

3. Enabling actuation of the aforesaid tool with detachable wrenches, extensions or the like.

To meet the foregoing objects, the invention provides for a chain-connecting tool comprising a narrow elongated body containing a lengthwise-extending threaded rod. The rod is journaled in and extends through both ends of the body. Each end of the rod bears a hexagonal bolt head. A chain hook is mounted on the threaded rod by means of an internally threaded block which moves lengthwise along the tool's body when the rod is turned. In one embodiment, a second chain hook is mounted on one end of the body and the rod is threaded in only one direction. In another embodiment, the second chain hook is mounted on another internally-threaded block and the threaded rod has approximately one half threaded in each direction from its center. The chain hooks or jaws are gently curved toward one another and are tapered so as to fit both small and large gauge roller chains, the large chains being at least twice the size of the small chains. The sides of the body are spaced laterally apart from the threaded rod and from the sides of the internally-threaded block or blocks so that one or both hooks can rotate through a small angular range for easy manipulation of the tool in awkward locations.

The foregoing and other objects, features and advantages of the invention will become more apparent from the following detailed description of two preferred embodiments of the invention, which proceeds with reference to the accompanying drawing.

BRIEF DESCRIPTION OF THE DRAWING

FIG. 1 is a top perspective view of one embodiment of the invention positioned beneath a section of roller chain C.

FIG. 2 is a longitudinal sectional view of the tool and roller chain of FIG. 1, the tool positioned on chain C for connecting the end lengths thereof together.

FIG. 3 is a top elevational view of a second embodiment of a roller chain connecting tool according to the invention.

FIG. 4 is a top plan view of the tool of FIG. 3.

FIG. 5 is a cross-sectional view taken along lines 5—5 in FIGS. 1 and 4.

FIG. 6 is an enlarged side elevational view of one of the roller chain hooks on the tool of FIGS. 1-5.

FIG. 7 is a front elevational view of the chain hook of FIG. 6.

DETAILED DESCRIPTION OF PREFERRED EMBODIMENTS

General Construction

Two embodiments of roller chain-connecting tools 10, 10*a* are disclosed hereinafter. Referring to FIGS. 1 and 3, each tool comprises an elongated body 12, a threaded rod 14, 14*a*, rotating means 16, 17 at each end of the rod and two opposed roller chain hooks 18, 20 mounted for relative motion lengthwise of the body by turning the rod.

The tool's body 12 includes a pair of elongated parallel side bars of equal length. Adjacent ends of the side bars are connected to opposite sides of two end blocks 24, 25 at each end of the tool. The end blocks are bored out along a common axis to provide internally smooth, cylindrical bearing surfaces 26.

The threaded rod is positioned within the body of the tool in parallel relationship to the side bars 22. End portions 28 of the rod extend through the end blocks 24, 25. The end portions are preferably smooth and have a diameter which fits just loosely enough within the cylindrical bearing surfaces 26 to enable easy rotation of the rod in the end blocks.

The rotating means 16, 17 are hexagonal bolt heads mounted on the ends of the threaded rod. The bolt heads are preferably sized to fit a common size open-end, box or socket wrench. Such bolt heads abut the end blocks with sufficient clearance to allow the bolt heads to turn freely of the end blocks. Washers (not shown) can be mounted on the rod between the bolt heads and the end blocks. The bolt heads should be keyed or welded to the threaded rod as a final step in assembly of the tool.

Hook 18 is carried on an internally-threaded nut or block 30 threaded onto the rod. Referring to FIGS. 4 and 5, block 30 has its lateral sides spaced inwardly from the inwardly opposed sides of side bars 22. This spacing should be sufficient to allow the nut to rotate through a small angular range, for example, thirty degrees, as indicated by arrow 32 in FIG. 5.

Referring to FIGS. 6 and 7, hooks 18, 20 are concavely curved to define an arc of about two radians at a radius corresponding to the radius of the largest size roller chain on which the tool is to be used. For example, if the largest size roller chain on which the tool is to be used has rollers of approximately $1\frac{1}{4}$ inch in diameter (for 200 pitch chain), then the inner concave surface 34 of the hooks would have a radius of about $1\frac{1}{4}$ to $1\frac{1}{2}$ inches. The profile of surface 34 should approximate a circle, but need not be precisely circular.

Hooks 18, 20 are tapered so that they can be used with roller chains of different sizes. Specifically, they are tapered inwardly in a longitudinal cross-sectional direction from a thick base 36 to a thin upper end 38 remote from block 30, as shown in FIG. 6. This feature enables the same hooks to be used with small radius rollers 40*a*, medium radius rollers 40*b* or large radius rollers 40*c*. Preferably, most of the longitudinal taper is in approximately the upper half of the hooks. The hooks are also tapered in a transverse cross-sectional direction proceeding from base 36 toward tip 38, as shown in FIG. 7. Tapering in the transverse direction enables the hooks to fit into roller chains having narrowly-spaced side plates 42*a*, medium-spaced side plates 42*b*, or widely-spaced side plates 42*c*.

In the foregoing example, the hooks would fit as small as 60 pitch chain and as large as 200 pitch chain. This range encompasses the entire range of sizes that are ordinarily encountered in lumber mills. At the same time, the preferred manner of longitudinally tapering the hooks provides sufficient strength to avoid bending or breaking when stretching very heavy roller chains. In addition, the tapered shapes permit the very heavy roller chain to be positioned more closely to block 30, to minimize torsion on the threaded block 30 and on the threads of the threaded rod.

FIG. 1 Embodiment

Referring to FIGS. 1 and 2, rod 14 is threaded in one direction, for example, with right-hand threads. Hook 20 is connected to end block 25 with its concave surface 34 facing the concave surface of hook 18. When rotating means 17 is operated to turn the threaded rod 14, for example, in a right-hand direction, block 30 and hook 18 move toward hook 20 to bring the ends of the roller chain together so that a master link 44 can be inserted, as shown in FIG. 2.

FIG. 3 Embodiment

Referring to FIGS. 3 and 4, rod 14*a* is threaded in one direction, for example, with right-hand threads, along one half portion 46 and oppositely-threaded along the other half portion 48. Block 30 is threaded onto rod portion 46. A second internally-threaded block 50, carrying hook 20, is mounted on the oppositely-threaded portion 48.

Operation of rotating means 17 to turn the threaded rod 14*a*, for example, in the right-hand direction, simultaneously moves blocks 30, 50 toward one another to interconnect the roller chain end links engaged by hooks 18, 20. Rotation in the opposite direction spreads the hooks apart for initial positioning on the end lengths of the chain. Although somewhat more complex than tool 10, tool 10*a* can be operated twice as fast as tool 10, assuming the same pitch threads are used in each tool. Another advantage of tool 10*a* is that both blocks 30 and 50 can be rotated through a small angular range about the rod. Their combined range of rotation is twice that of tool 10. This feature makes it even easier to maneuver the tool in very tight quarters, for example, behind a guard shield, to position first one and then the other hook in opposite ends of the roller chain.

Having illustrated and described two preferred embodiments of the invention, it should be apparent to those skilled in the art that the invention may be modified in arrangement and detail. I claim as my invention all such modifications as come within the spirit and scope of the following claims.

I claim:

1. A chain-connecting tool for pulling the opposite ends of a chain toward one another for interconnection, the tool comprising:

an elongated body having spaced ends;

a threaded rod mounted for axial rotation in the body, the rod having end portions journaled in and extending through each end of the body and rigidly supported thereby;

rotating means for rotating said rod independently of the body;

a pair of chain-engaging means for engaging said chain ends; and mounting means threadedly mounting at least one of the pair of chain-engaging means on the rod for movement therealong toward the other chain-engaging means when the rotating means is actuated to rotate the rod for pulling said end links toward one another;

the mounting means being spaced laterally inwardly of said body a distance enabling the mounting means to be rotated relative to said body through a predetermined angular range for positioning the chain-engaging means on the ends of said chain.

2. A tool according to claim 1 in which the rotation means is a hexagonal bolt head mounted on each end of said rod.

3. A tool according to claim 1 in which the chain-engaging means comprises curved chain hooks transversely tapered toward their ends so as to fit a range of roller chain sizes including a first roller chain of a given size and a second roller chain of at least twice the size of the first roller chain.

4. A tool according to claim 1 in which said rod is threaded in only one direction and one of said chain-engaging means is immovably mounted on one end of said body.

5. A tool according to claim 1 in which said rod is threaded in one direction along a first portion and is threaded in an opposite direction along the second portion, each chain-engaging means being movably mounted on the rod by said mounting means.

6. A roller chain-tightening tool for pulling the end links of a roller chain together for interconnection, the tool comprising:

a threaded rod;

means defining a body extending along the rod and supportably mounting each end of the rod in a journaled end thereof;

rotation means connected to each end of the rod for axially rotating the rod independently of the body;

internally-threaded mounting-means received on the rod and operable for movement therealong independently of the body when the rod is rotated;

a first chain hook immovably mounted on one end of said body; and a second chain hook mounted on the mounting means;

the chain hooks being curved toward one another to engage said end links and pull them toward one another when the rod is rotated;

the mounting means being spaced laterally inwardly of said body a distance enabling the mounting means to be rotated relative to said body through a predetermined angular range for positioning the chain-engaging means on the ends of said chain.

7. A roller chain-tightening tool for pulling the end links of a roller chain together for interconnection; the tool comprising:

a threaded rod;

means defining a body extending along the rod and supportably mounting each end of the rod in a journaled end thereof;

rotation means connected to each end of the rod for axially rotating the rod independently of the body;

a pair of internally-threaded mounting means received on opposite portions of the rod and operable for movement therealong independently of the body when the rod is rotated; and a chain hook mounted on each of the mounting means, the chain hooks being curved toward one another to engage said end links;

the rod being oppositely threaded along said opposite portions so as to move the mounting means and hooks toward one another when the rod is rotated;

the mounting means being spaced laterally inwardly of said body a distance enabling the mounting means to be rotated relative to said body through a predetermined angular range for positioning the chain-engaging means on the ends of said chain.

8. A tool according to claims 6 or 7 in which each of the chain hooks is a curved member dimensioned to enclose about one third of the circumference of a roller of a roller chain link of a first size with substantially the full length of said hook inserted into said link, said member being transversely tapered at a distal end thereof for insertion of a portion of said end in a roller chain link of less than half of said first size.

* * * * *